US007607379B2

(12) United States Patent
Rospek et al.

(10) Patent No.: US 7,607,379 B2
(45) Date of Patent: Oct. 27, 2009

(54) PERFORATION GUN SYSTEM FOR SEALING PERFORATION HOLES

(75) Inventors: Rolf Rospek, Edernissen (DE); Malte Veehmayer, Siegburg (DE); Wilfried Krauthäuser, Troisdorf (DE)

(73) Assignee: Dynaenergetics GmbH & Co. KG, Troisdorf (DE)

( * ) Notice: Subject to any disclaimer, the term of this patent is extended or adjusted under 35 U.S.C. 154(b) by 201 days.

(21) Appl. No.: 10/573,581

(22) PCT Filed: Sep. 22, 2004

(86) PCT No.: PCT/EP2004/010609

§ 371 (c)(1),
(2), (4) Date: Jan. 12, 2007

(87) PCT Pub. No.: WO2005/033472

PCT Pub. Date: Apr. 14, 2005

(65) Prior Publication Data

US 2007/0107589 A1 May 17, 2007

(30) Foreign Application Priority Data

| | | |
|---|---|---|
| Sep. 27, 2003 | (DE) | 103 44 958 |
| Jan. 30, 2004 | (DE) | 10 2004 004 750 |
| Mar. 10, 2004 | (DE) | 10 2004 011 616 |
| Sep. 11, 2004 | (DE) | 10 2004 043 948 |

(51) Int. Cl.
*E21B 43/11* (2006.01)

(52) U.S. Cl. ..... 89/1.15; 166/55.2

(58) Field of Classification Search ..... 89/1.15; 166/55.2, 297; 175/2
See application file for complete search history.

(56) References Cited

U.S. PATENT DOCUMENTS

| | | | | |
|---|---|---|---|---|
| 2,142,572 | A * | 1/1939 | Metzner | 175/4.55 |
| 2,252,270 | A * | 8/1941 | Miller | 175/4.55 |
| 2,462,784 | A * | 2/1949 | Smith | 175/4.58 |
| 3,361,204 | A * | 1/1968 | Howard et al. | 166/290 |
| 3,366,179 | A * | 1/1968 | Kinley et al. | 166/55.3 |
| 4,637,478 | A * | 1/1987 | George | 175/4.51 |
| 6,679,327 | B2 * | 1/2004 | Sloan et al. | 166/297 |
| 2007/0079966 | A1 * | 4/2007 | George et al. | 166/297 |

FOREIGN PATENT DOCUMENTS

| | | |
|---|---|---|
| WO | WO 00/49271 | 8/2000 |

* cited by examiner

*Primary Examiner*—Bret Hayes
(74) *Attorney, Agent, or Firm*—Antonelli, Terry, Stout & Kraus, LLP.

(57) ABSTRACT

A perforation gun includes an external gun barrel in the interior of which perforators are located which can be ignited via a fuse extending through the gun barrel and which, after ignition, pierce the gun barrel with perforation holes. A sliding tube or a swellable two-component foam is provided which automatically closes the perforation holes. The swellable two-component foam can be provided in a cartridge located inside the gun barrel and can be broken up by the ignited fuse, thereby allowing foam to escape from the cartridges, allowing it to swell and obliterate the perforation holes. The sliding tube can be displaced after perforation by an adjusting device by at least the diameter of the perforation hole, the sliding tube being located coaxially between the perforators and the gun barrel.

7 Claims, 4 Drawing Sheets

PERFORATION GUN SYSTEM FOR SEALING PERFORATION HOLES

Figure 1:
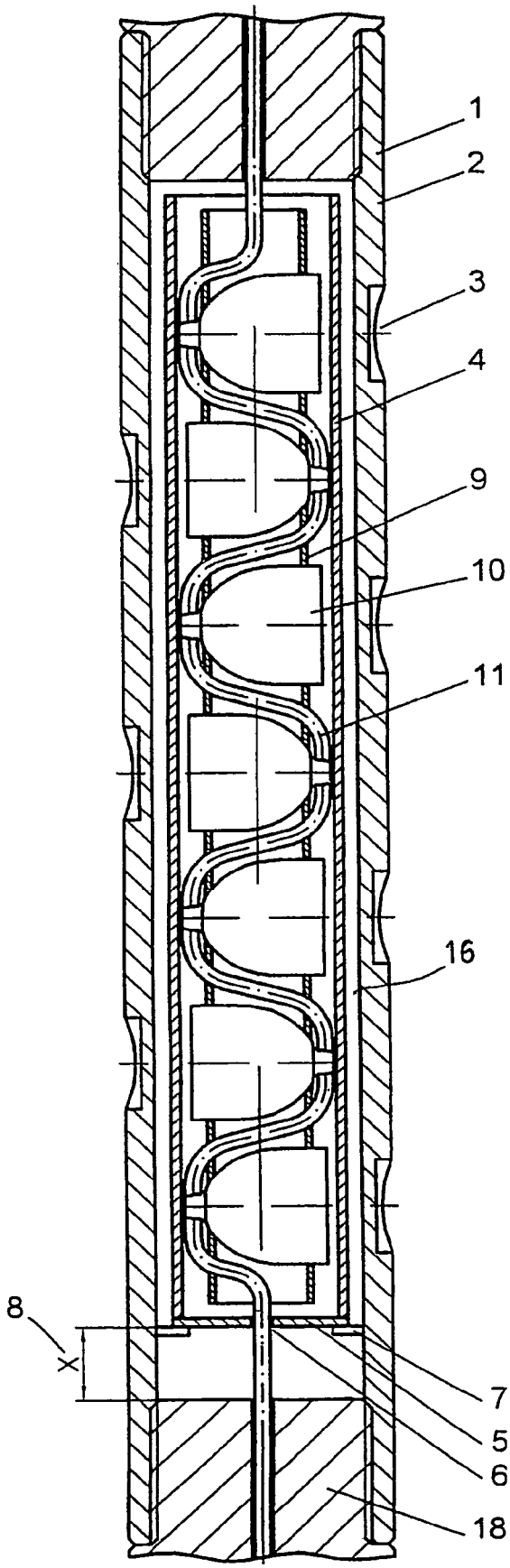

The invention relates to a perforation gun having an outer gun barrel, arranged in an interior of which are perforators that can be ignited by a fuse leading through the gun barrel and after ignition pierce the gun barrel at penetration holes, and means for automatically closing the penetration holes.

Perforation guns are used in deep bore hole blasting in the oil and natural-gas industries to tie the bore hole to the storage horizon.

A perforation gun consists of an outer gun barrel, arranged in the interior of which there are perforators—usually hollow or projectile charges—that shoot radially outwards through the gun barrel in the case of ignition. Penetration holes remain in the gun barrel after the shot.

In order to ignite the perforators there is a fuse leading through the gun barrel that causes the perforators to ignite in the case of ignition.

In the case of this method a problem is presented by residual pieces and fragments of the perforators and of the components in the interior of the gun barrel that can fall into the bore hole through the penetration holes after the shot. In order to avoid this "debris" (fragments of the perforators), in WO 00/49 271 it is proposed that, in order to close the penetration holes independently, a sliding tube, which can be displaced outside the gun barrel on the outer wall of the gun barrel, be displaced by means of an adjusting arrangement by at least the diameter of the penetration hole after the shot. This system has disadvantages in horizontal bore holes, since here the sliding tube rests on the "casing inner wall" and as a result displacement of the sliding tube is rendered difficult. What is meant by the term casing is the outermost tube that is introduced into the bore hole and into which the perforation gun is inserted.

The underlying object of the invention is to improve a perforation gun in such a way that with simple and reliable means emergence of fragments out of the gun barrel into the bore hole is avoided.

In accordance with the invention this object is achieved in a first embodiment in that the means for the automatic closure comprise cartridges with a swellable two-component foam, and these cartridges are arranged in the gun barrel and can be broken up by means of the ignited fuse, as a result of which foam emerges out of the cartridges, swells up and blocks the penetration holes.

In a preferred embodiment, a cartridge is arranged next to each perforator.

In the case of perforation guns that have an outer gun barrel, arranged in the interior of which there are perforators that can be ignited by way of a fuse leading through the gun barrel and after ignition pierce the gun barrel at penetration holes, with means being provided for automatically closing the perforation holes, and these means comprising a sliding tube which can be displaced by means of an adjusting arrangement by at least the diameter of the penetration hole after the penetration, it is proposed that the sliding tube be arranged coaxially between the perforators and the gun barrel. As a result, emergence of fragments out of the gun barrel into the bore hole is avoided with simple and reliable means. In the case of horizontal bore holes, in which the outer wall rests on the casing inner wall, displacement of the sliding tube is possible in a reliable way.

In a preferred embodiment, the sliding tube is fixed in its starting position by way of a securing element that breaks up after ignition of the fuse and enables the displacement of the sliding tube.

The adjusting arrangement can be a tensioned spring or a pyrotechnic element that can be ignited by means of the fuse.

In a preferred embodiment the sliding tube is closed on the side to which it is to be displaced and is open on the other side, as a result of which the sliding tube is formed like a plunger that can be displaced by means of the pressure building up as a result of the ignition of the perforators.

In order to fix the sliding tube after the displacement, it is proposed that the sliding tube have a wall thickness that permits radial expansion as a result of the pressure that has built up in the gun barrel after the ignition of the perforators.

Advantageously, arranged between the sliding tube and the gun barrel there is a fluid. This fluid can be used to control the timing of the radial expansion of the sliding tube.

An embodiment of the invention is explained in greater detail in the following with the aid of four figures.

FIG. 1 shows a gun barrel 1 of a perforation gun for use in the oil and natural-gas industries for tying a bore hole to the storage horizon. The gun barrel 1 is closed at its two ends by means of a respective connector or seal 18. Arranged in the interior of the gun barrel 1 there is a sliding tube 4 and therein a charge carrier 9, to which perforators 10 are secured. In the figures shown, these perforators 10 are hollow charges. In order to ignite these perforators 10, a fuse 11 is guided to the respective ignition points of the perforators 10. The fuse 11 is guided through the connectors or seals 18 into the interior of the perforation gun.

The inner tube or the sliding tube 4 is closed at one end, for example by means of a cap 5. Lying next to the cap 5 there is a securing element 7, here a shearing pin, that secures the sliding tube 4 before the shot in such a way that the sliding tube 4 cannot be displaced in the gun barrel 1 in the longitudinal direction.

Predetermined breaking points 3 can be introduced into the gun barrel 1, opposite the perforators 10, so that after the ignition of the perforators 10 the hollow-charge stream 12 that forms (see FIG. 2) can pierce the gun barrel 1 in an unhindered manner.

Figure 2:
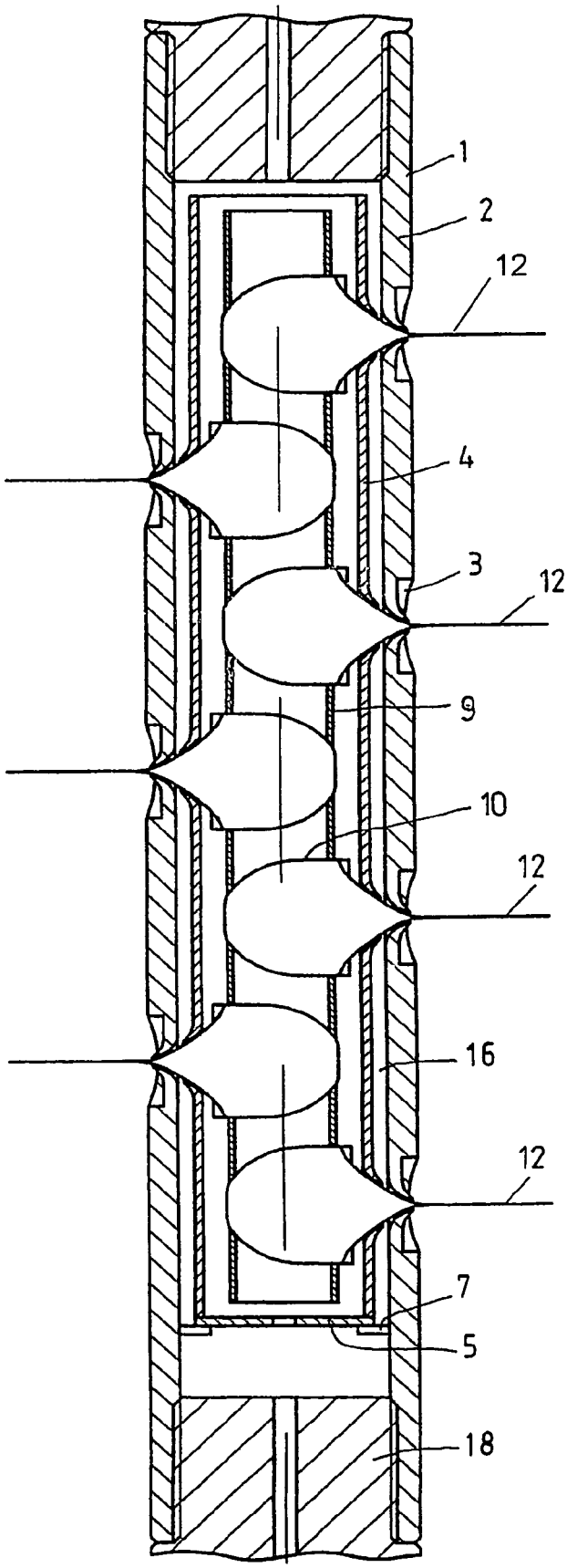

FIG. 2 shows a cutaway portion from the perforation gun directly after the ignition. The fuse 11 has ignited the perforators 10. The hollow-charge stream or hollow-charge jet 12 that forms has pierced the sliding tube 4 and the gun barrel 1. The metal housings of the perforators 10 are split up thereby and form splinter pieces and fragments that form a portion of the "debris".

Figure 3:
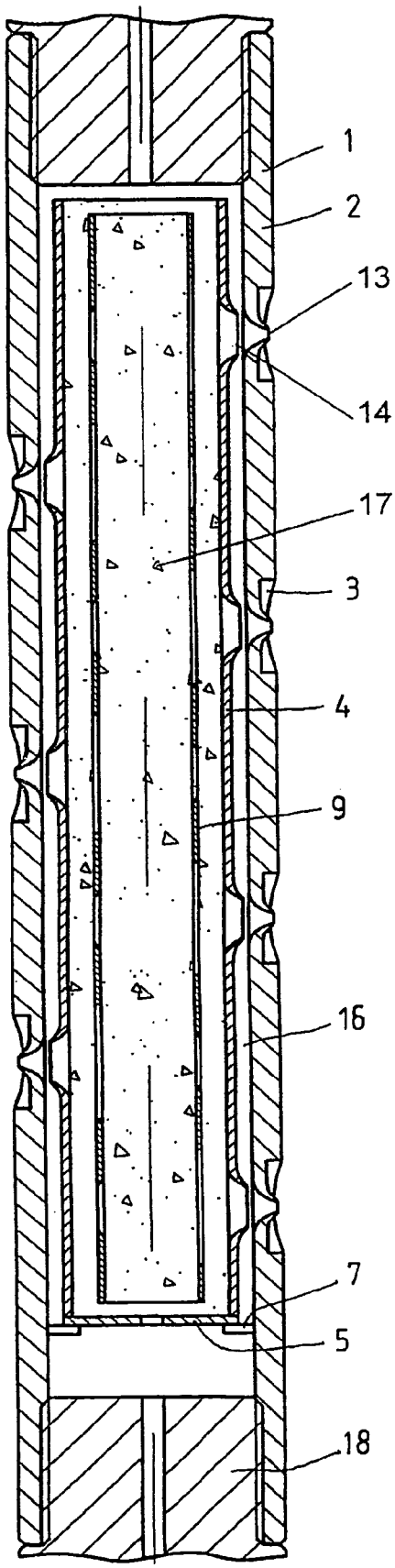

FIG. 3 shows a cutaway portion from the perforation gun directly after the shot. The hollow-charge stream 12 has pierced the sliding tube 4 at the penetration hole 14 and the gun barrel 1 at the penetration hole 13. A pressure has built up in the interior of the sliding tube 4. This pressure acts upon the sliding tube 4 in the direction of the securing element 7, since the sliding tube 4 is closed on the side of the securing element 5 by means of a cap 5 and is open on the opposite side. "Debris" 17 has formed in the interior.

Figure 4:
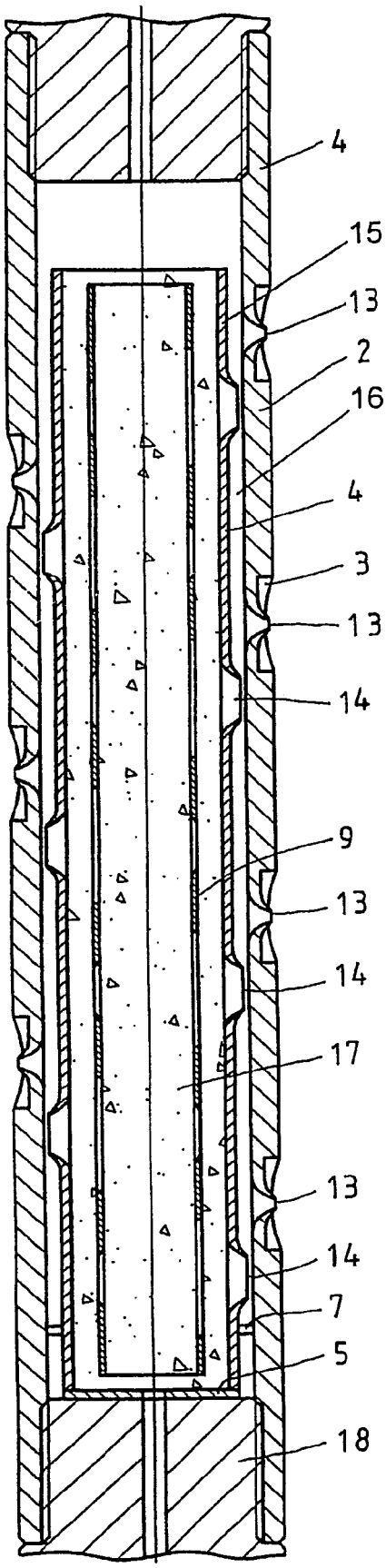

FIG. 4 shows a cutaway portion from the perforation gun after the shot. As a result of the pressure in the sliding tube 4, the securing element 7 has been sheared off, as a result of which the sliding tube 4 has been displaced as far as the adjacent connector or seal 18. As a result, the remaining small portions or the debris 17 cannot leave the gun barrel 1. What is not shown is that the inner tube 4 has become inflated after the shot and has thus become wedged with the gun barrel 1.

The invention thus consists of a mechanism that closes the perforation holes or penetration holes 13 in the gun wall 2 after the shot and thus prevents the "debris" 17 from emerging. Foam cartridges or, as described, a slide or rotary mechanism can be used as a closure mechanism. In the case of the foam cartridges, some perforators 10 are replaced by cartridges with a two-component foam. By means of the fuse 11 that ignites the perforators or charges 10, the cartridge is caused to react, and the foam swells up and blocks the penetration holes 13.

When a sliding or rotary mechanism is used, a second tube, a sliding tube 4, which is displaced by at least the diameter of the penetration hole 13 after the penetration (either longitudinally: sliding mechanism, or transversely: rotary mechanism), is inserted into the gun. In FIG. 1, the path of displacement is marked by an X (see reference numeral 8). A pretensioned spring can be used for the movement of the inner tube or second tube or sliding tube 4 after the shot. The sliding tube 4 is fixed in the starting position by way of a securing element 7 which is destroyed by the fuse 11, for example. Pins, snap rings or screws, for example, can be used as the securing element 7. The destruction can also be effected, for example, by way of a pyrotechnic element—possibly even with a delay-action composition. The internal pressure in the gun after the shot, caused by the reaction products of the explosives in the perforators 10, can also be used to move the slide mechanism or the slide tube 5 (sic). If the slide tube 4 is closed on the side to which it is to be moved and is kept open on the other side, this sliding tube 4 can be moved like a plunger. The internal pressure can only be relieved through the perforation holes 14 and the leadthroughs 6 for the fuse 11. The time until the pressure has been completely reduced is sufficient to displace the sliding tube 4 and thus to close the penetration holes 13, 14. At the same time, the gas pressure causes the sliding tube 4 to inflate (also known for conventional perforation guns by the term "gun swell"). The expanding sliding tube 4 can become wedged with the inner wall of the outer tube or gun barrel 1 and thus cannot slip back. The time of this expansion can be controlled, for example, by way of a fluid between the inner and outer wall. Grease or silicone oil, for example, can be used for this purpose.

The invention claimed is:

1. A perforation gun having an outer gun barrel, arranged in an interior of which are perforators that can be ignited by a fuse leading through the gun barrel and after ignition pierce the gun barrel at penetration holes, wherein means for automatic closing the penetration holes are provided, and the means comprise a sliding tube displaced by an adjusting arrangement by at least the diameter of the penetration holes after being pierced, characterized in that the sliding tube is arranged coaxially between the perforators and the gun barrel.

2. A perforation gun according to claim 1, characterised in that the sliding tube is fixed in a starting position by a securing element that breaks up after ignition of the fuse and enables the displacement of the sliding tube.

3. A perforation gun according to claim 1, characterised in that the adjusting arrangement is a tensioned spring.

4. A perforation gun according to claim 1, characterised in that the adjusting arrangement is a pyrotechnic element ignited by the fuse.

5. A perforation gun according to claim 1, characterised in that the sliding tube is closed on an end facing a direction in which the sliding tube is to be displaced and is open on an opposite end, and as a result can be displaced like a plunger by pressure building up as a result of the ignition of the perforators.

6. A perforation gun according to claim 1, characterised in that the sliding tube has a wall thickness that permits radial expansion and fixation in the gun barrel after the sliding tube has been displaced as a result of pressure that has built up in the gun barrel after the ignition of the perforators.

7. A perforation gun according to claim 1, characterised in that a fluid is disposed between the sliding tube and the gun barrel.

* * * * *